US008313190B2

(12) United States Patent
Castillo et al.

(10) Patent No.: US 8,313,190 B2
(45) Date of Patent: Nov. 20, 2012

(54) SYSTEM AND METHOD FOR STRIPPING MEDIA FROM AN OFFSET IMAGING MEMBER IN AN INKJET PRINTER

(75) Inventors: Ruddy Castillo, Briarwood, NY (US); Daniel J. McVeigh, Webster, NY (US); Donald M. Bott, Rochester, NY (US); Barry P. Mandel, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 309 days.

(21) Appl. No.: 12/722,333

(22) Filed: Mar. 11, 2010

(65) Prior Publication Data

US 2011/0221842 A1 Sep. 15, 2011

(51) Int. Cl.
*B41J 2/01* (2006.01)

(52) U.S. Cl. ..... 347/104; 156/358; 271/307; 271/308; 271/311; 399/148; 399/323; 399/351; 399/399

(58) Field of Classification Search ..... None
See application file for complete search history.

(56) References Cited

U.S. PATENT DOCUMENTS 3,604,115 A 9/1971 McDonald
3,921,181 A 11/1975 Hauser
4,156,524 A * 5/1979 Bar-on et al. ..... 271/311
4,806,967 A 2/1989 Newbury
5,160,130 A 11/1992 Fromm et al.
5,279,697 A * 1/1994 Peterson et al. ..... 156/358
5,368,291 A 11/1994 MacNiel
5,570,775 A 11/1996 Kleinhans et al.
5,749,030 A 5/1998 Park
5,779,370 A 7/1998 Schroeder et al.
6,293,545 B1 9/2001 Hanks et al.
6,741,829 B2 5/2004 Stickler et al.
6,839,537 B2 * 1/2005 Mouri et al. ..... 399/323
6,986,575 B1 1/2006 Gordon et al.
7,310,491 B2 * 12/2007 Pawlik et al. ..... 399/323
2007/0009286 A1 1/2007 Bryant et al.

* cited by examiner

*Primary Examiner* — Matthew Luu
*Assistant Examiner* — John P Zimmermann
(74) *Attorney, Agent, or Firm* — Maginot, Moore & Beck, LLP

(57) ABSTRACT

A stripper blade system has been developed for high throughput inkjet printers. The stripper blade system includes a metallic blade having a leading edge that is less than 0.06 mm in thickness, a blade holder to which the metallic blade is mounted, and an actuator that is associated with the blade holder to move the metallic blade into and out of contact with an intermediate imaging member.

7 Claims, 6 Drawing Sheets

SYSTEM AND METHOD FOR STRIPPING MEDIA FROM AN OFFSET IMAGING MEMBER IN AN INKJET PRINTER

TECHNICAL FIELD

This disclosure relates generally to printers having an intermediate imaging member and, more particularly, to the components and methods for facilitating removal of media from an offset imaging member or other cylindrical roller, such as a fuser roller.

BACKGROUND

In known printing systems having an intermediate imaging member, the print process includes an imaging phase, a transfix phase, and an overhead phase. In inkjet printing systems, the imaging phase is the portion of the print process in which the ink is expelled from the print head in an image pattern onto a print drum or other intermediate imaging member. The transfix phase is the portion of the print process in which the ink image on the print drum is transferred from the intermediate imaging member to the recording medium. The image transfer typically occurs by bringing a transfix roller into contact with the imaging member to form a nip. A recording medium arrives at the nip as the print drum rotates the image through the nip. The pressure in the nip helps transfer the malleable image inks from the print drum to the recording medium. In the overhead phase, the trailing edge of the recording medium passes out of the nip and the transfix roller is released from contacting the imaging member. The removal of the transfix member helps release the media from the intermediate imaging member. In some intermediate imaging printers, a stripper blade may be moved into position to intervene between the leading edge of a media leaving the transfix nip and the intermediate imaging member to facilitate separation of the media from the intermediate imaging member.

Inkjet printers that use intermediate imaging members, sometimes called offset printers, have been developed with higher throughput rates. Some of these printers have intermediate imaging members that have larger circumferences than previously known printers. The high transfix load pressure and the speed of the intermediate imaging member in higher throughput printers lead to high adhesive forces between the media and the intermediate imaging member. These adhesive forces make stripping the media from the intermediate imaging member with known stripping systems more difficult. A system that separates media with a higher adhesion force from an intermediate imaging member benefits the field of offset printing.

Other known cylindrical roller systems are used to fuse toner onto media after transfer of an image to the media. These fuser rollers can generate high pressure to enable the use of lower roller temperatures. When media passes through a fusing nip generating high pressure, the media can adhere to the roller and make media stripping a challenge. A system that separates media with high adhesion force from a high pressure fuser roller benefits the field of high pressure fusing.

SUMMARY

A stripper blade system has been developed that reliably strips media from an intermediate imaging member in an inkjet printer. The stripper blade system includes a metallic blade having a leading edge that is less than 0.06 millimeters in thickness, a blade holder to which the metallic blade is mounted, and an actuator that is associated with the blade holder to move the metallic blade into and out of contact with an intermediate imaging member.

The stripper blade system may be adapted for use in a xerography system to strip media from a fuser roller. The stripper blade system for a xerography system includes a metallic blade having a leading edge that is less than 0.06 millimeters in thickness, a blade holder to which the metallic blade is mounted, a stop member mounted proximate a fuser roller, and an actuator that is associated with the blade holder to move the metallic blade into and out of contact with the stop member to bias the leading edge of the metallic blade against the fuser roller to enable stripping of media from the fuser roller after the media exits a nip formed with the fuser roller.

A method that may be implemented with the stripper blade system includes moving a blade holder attached to a stainless steel blade having a leading edge with a thickness of no more than 0.06 millimeters to a position that enables the leading edge of the stainless steel blade to contact a cylindrical roller to facilitate separation of a leading edge of media on the cylindrical roller from the cylindrical roller, and moving the blade holder after expiration of a predetermined time period to disengage the leading edge of the stainless steel blade from the cylindrical roller.

A printer includes a print drum for receiving ink ejected by a print head, a transfix roller located proximate to the print drum, a stripper blade system, and a controller. The stripper blade system includes a metallic blade having a leading edge that is less than 0.06 millimeters in thickness, a blade holder to which the metallic blade is mounted; and an actuator that is associated with the blade holder to move the metallic blade into and out of contact with the print drum. The controller is configured to operate the transfix roller to form a transfix nip with the print drum selectively and to move the blade holder to contact the print drum with the leading edge of the metallic blade with the print drum to facilitate removal of media from the print drum.

BRIEF DESCRIPTION OF THE DRAWINGS

The foregoing aspects and other features of an inkjet printer implementing a stripper blade system are explained in the following description, taken in connection with the accompanying drawings, wherein.

DETAILED DESCRIPTION

Figure 7:
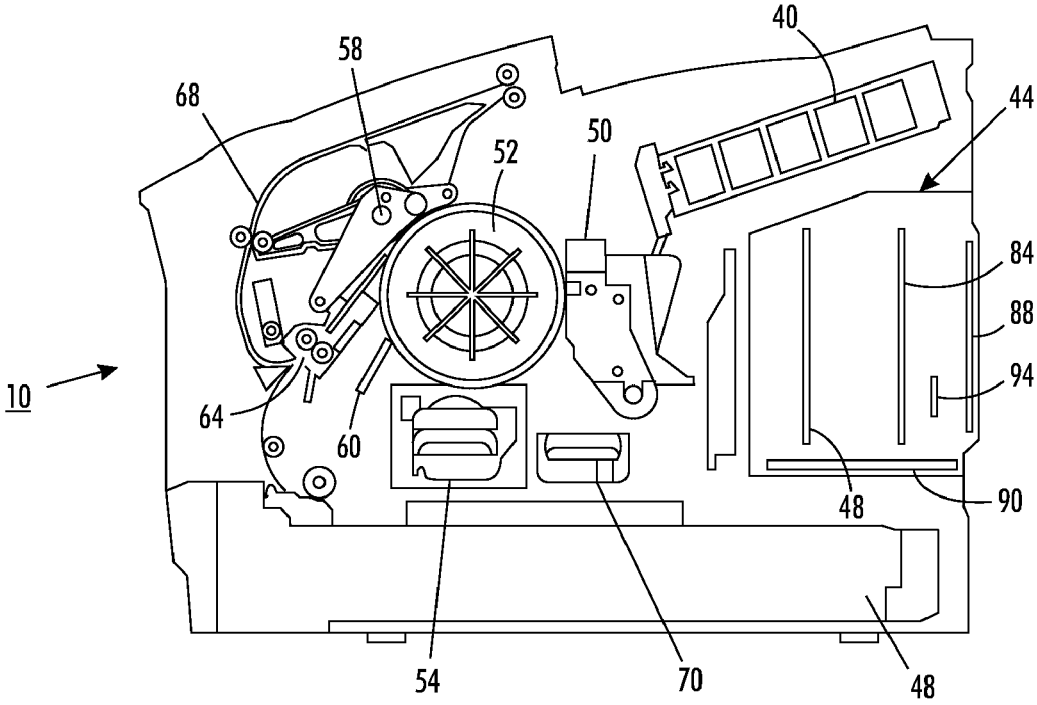
FIG. 7 PRIOR ART
FIG. 7 is a side view of a prior art inkjet printer.

Referring to FIG. 7, there is shown a side view of a prior art inkjet printer 10 that may be modified to include a stripper blade system that reduces undesirable ink transfer during the printing process. The reader should understand that the embodiment of the print process discussed below may be implemented in many alternate forms and variations. In addition, any suitable size, shape or type of elements or materials may be used.

As shown in FIG. 7, the inkjet printer 10 may include an ink loader 40, an electronics module 44, a paper/media tray 48, a print head 50, an intermediate imaging member 52, a drum maintenance subsystem 54, a transfix subsystem 58, a wiper subassembly 60, a paper/media preheater 64, a duplex print path 68, and an ink waste tray 70. In brief, solid ink sticks are loaded into ink loader 40 through which they travel to a melt plate (not shown). At the melt plate, the ink stick is melted and the liquid ink is diverted to a reservoir in the print head 50. The ink is ejected by piezoelectric elements to form an image on the intermediate imaging member 52 as the member rotates. Member 52 is called an intermediate imaging member because an ink image is formed on the member and then transferred to media in the transfix subsystem. This printing process is a type of offsetting printing. The intermediate imaging member may also be called a print drum.

An intermediate imaging member heater is controlled by a controller to maintain the imaging member within an optimal temperature range for generating an ink image and transferring it to a sheet of recording media. A sheet of recording media is removed from the paper/media tray 48 and directed into the paper pre-heater 64 so the sheet of recording media is heated to a more optimal temperature for receiving the ink image. A synchronizer delivers the sheet of the recording media so its movement between the transfix roller in the transfer subsystem 58 and the intermediate image member 52 is coordinated for the transfer of the image from the imaging member to the sheet of recording media.

The operations of the inkjet printer 10 are controlled by the electronics module 44. The electronics module 44 includes a power supply 80, a main board 84 with a controller, memory, and interface components (not shown), a hard drive 88, a power control board 90, and a configuration card 94. The power supply 80 generates various power levels for the various components and subsystems of the inkjet printer 10. The power control board 90 regulates these power levels. The configuration card contains data in nonvolatile memory that defines the various operating parameters and configurations for the components and subsystems of the inkjet printer 10. The hard drive stores data used for operating the inkjet printer and software modules that may be loaded and executed in the memory on the main card 84. The main board 84 includes the controller that operates the inkjet printer 10 is configured in accordance with an operating program executing in the memory of the main board 84. The controller receives signals from the various components and subsystems of the inkjet printer 10 through interface components on the main board 84. The controller also generates control signals that are delivered to the components and subsystems through the interface components. These control signals, for example, drive the piezoelectric elements to expel ink from the print heads to form the image on the imaging member 52 as the member rotates past the print head. The printer depicted in FIG. 7 is merely exemplary of a printer suitable for adaptation with a stripper blade system, and the stripper blade system described herein may be used in a variety of printers with alternative components and configurations. Furthermore, the stripper bade system described herein can also be used in other printer subsystems such as roll fusers, belt fusers, etc.

Figure 1A:
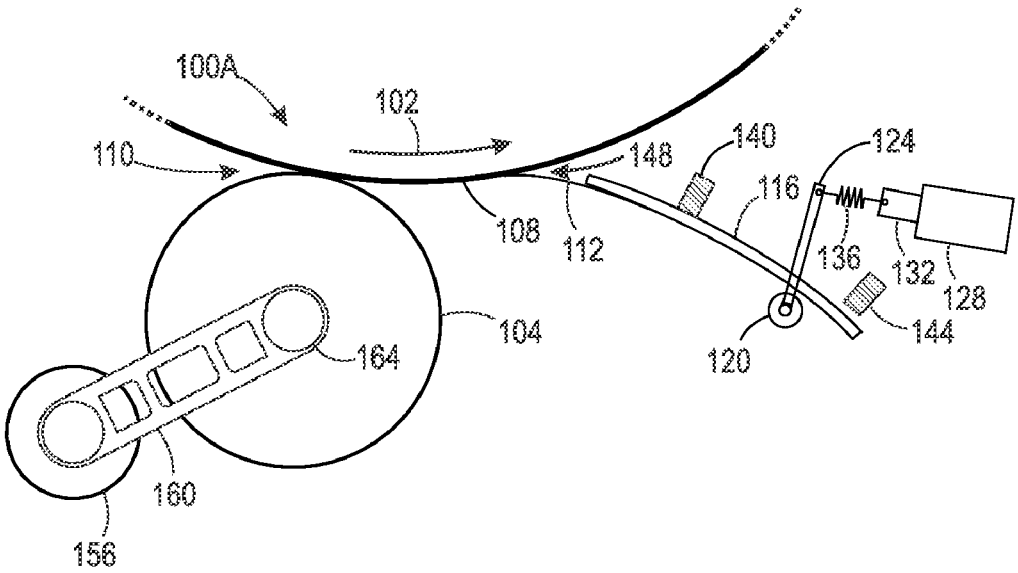
FIG. 1A is a side view of a stripper blade system where the leading edge of a metallic stripper blade is in contact with a print drum.
Figure 1B:
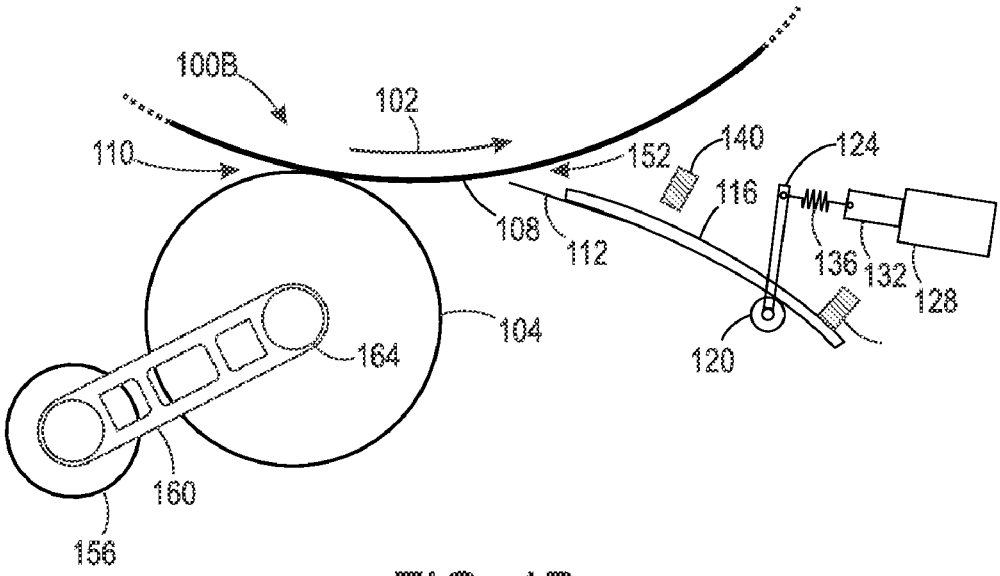
FIG. 1B is a side view of a stripper blade system where the leading edge of a metallic stripper blade is removed from a print drum.

A stripper blade system configured to remove print media from an intermediate imaging member or other cylindrical roller, such as a fuser roller or an unheated roller that contacts printed media, is depicted in FIGS. 1A and 1B. FIG. 1A shows the stripper system 100A with the stripper blade 112 biased against the surface of an intermediate imaging member, herein embodied as a print drum 108. FIG. 1A and FIG. 1B show the print drum configured to rotate in a counterclockwise direction shown by arrow 102. In the embodiment of FIG. 1A, the stripper blade 112 is biased against the surface of the print drum 108 at location 148 with a pressure of approximately 0.033 lb/in to about 0.083 lb/in. The stripper blade 112 is deformed by the biasing force, and the acute angle formed at location 148 between the print drum 108 and stripper blade 112 is between approximately 10 and 14 degrees. This angle is also known as the "angle of attack", and in the example embodiment these angle of attack ranges facilitate separating a print medium from the print drum 108. The deformation results in the stripper blade 112 having a curvature when biased against the print drum 108. The curvature allows the leading edge of stripper blade 112 to engage the print drum 108 uniformly. The stripper blade 112 has at least one metallic layer, which may be formed from stainless steel, although other materials may be used. The surface of print drum 108 is also metallic, typically being anodized aluminum. Generally, the stripper blade has a thickness of about one-half the thickness of the media most commonly used in the printer. In one embodiment, the media has a thickness of about 0.1 mm so the stripper blade has a thickness of about 0.06 mm.

The stripper blade 112 is attached to a blade holder 116. The blade holder 116 may be formed from a polymer compound, such as a thermoplastic adapted to secure the stripper blade 112, although other suitable materials may be used. The blade holder 116 engages a support arm 124 that is rotatably attached to a pivot 120 at one end and a spring 136 at the other end. The spring 136 is further attached to an actuator arm 132. The actuator arm 132 is controlled by an actuator 128, which is typically an electromechanical device such as a servo or solenoid. In the configuration of FIG. 1A, the actuator arm 132 is in a retracted position, pulling the spring 136, support arm 124 and blade holder 116 towards a stop member 140. The stop member 140 applies a reverse bias against the blade holder 116. The forces from actuator 128 and stop member 140 maintain the biasing pressure of approximately 0.033 lb/in to 0.083 lb/in as the print drum 108 rotates and the stripper blade 112 engages media sheets.

FIG. 1B depicts a stripper blade system 100B with the stripper blade 112 removed from the print drum 108. In this disengaged position, a gap 152 is formed between the stripper blade 112 and print drum 108. The actuator 128 extends actuator arm 132, pivoting support arm 124 and blade support 116 away from mechanical stop 140. As the blade support 116 moves away from the print drum 108, the end of the arm 116 furthest away from the print drum 108 moves to encounter the stop member 144. Thus, stop member 144 limits the travel of the blade support 116 during disengagement of the blade 112 from the drum 108 and the stop member 140 limits the travel of the blade support 116 during engagement of the blade 112 with the drum 108.

In both FIG. 1A and FIG. 1B the transfix roller 104 is positioned to form a transfix nip 110 with print drum 108. The transfix roller 104 may be moved into the nip position or removed from the nip position by rotation of a transfix roller actuator 156. The transfix roller 104 rotates freely about a central axis 164 in response to the rotation of the print drum 108, allowing media sheets to pass through the transfix nip 110. In the embodiment of FIG. 1A and FIG. 1B, the transfix roller actuator 156 engages the transfix roller 104 using at least one armature 160, although alternative embodiments may use other means of moving the transfix roller such as belts or a gearing system. The transfix roller actuator 156 is typically an electromechanical device such as an electric motor. The transfix roller actuator 156 may also rotate armature 160 and transfix roller 104 to a position removed from the transfix nip 110 when the printer is not transfixing an image to a print medium. When the transfix nip 110 is formed, the print drum 108 rotates in direction 102, carrying a media sheet through the transfix nip 110 towards the stripper blade 112. If the stripper blade 112 is engaged as show in FIG. 1A, the media sheet is separated from the print drum 108 starting at location 148.

The actuator 128 and transfix roller actuator 156 are both configured to operate in response to signals received from a controller (not shown). The controller may be a general purpose microprocessor that executes programmed instructions that are stored in a memory. The controller also includes the interface and input/output (I/O) components for receiving status signals from the printer and supplying control signals to the printer components. Alternatively, the controller may be a dedicated processor on a substrate with the necessary memory, interface, and I/O components also provided on the substrate. Such devices are sometimes known as application specific integrated circuits (ASIC). The controller may also be implemented with appropriately configured discrete electronic components or primarily as a computer program or as a combination of appropriately configured hardware and software components.

Figure 2:
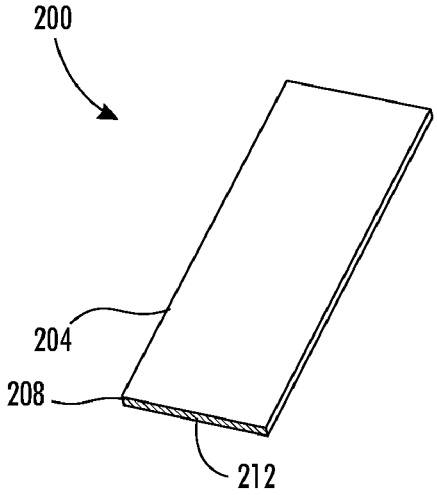
FIG. 2 is a perspective view of a stripper blade.

A stripper blade that may be used in the embodiment of FIG. 1A and FIG. 1B is depicted in FIG. 2. The stripper blade 200 is formed from a single sheet of a flexible material such as stainless steel. In the example embodiment of FIG. 2, the stripper blade 200 has a leading edge 204 adapted to contact an intermediate imaging member such as a print drum, which is typically made of anodized aluminum, although other materials may be used. The leading edge 204 depicted in FIG. 2 is 30 mm wide, although different lengths may be used in alternative embodiments. For the embodiment of FIG. 2, the stripper blade 200 has a thickness 208 of approximately 0.05 mm, and a length 212 of 12 mm. These dimensions provide the stripper blade 200 with sufficient strength and flexibility to be biased against a print drum for the purpose of stripping a media sheet from the print drum as shown in FIG. 1A. The length 212 is also sufficient to permit the stripper blade 200 to be held by a stripper blade holder such as the stripper blade holder 116 depicted in FIG. 1A. In alternative embodiments, the precise dimensions of the stripper blade 212 may vary according to the desired width of the leading edge 204, the desired angle of attack for the stripper blade, and material used to form the stripper blade. While the leading edge 204 of stripper blade 200 is depicted as a straight edge, alternative shapes such as a tapered edge forming a point in the leading edge are also envisioned.

Figure 3:
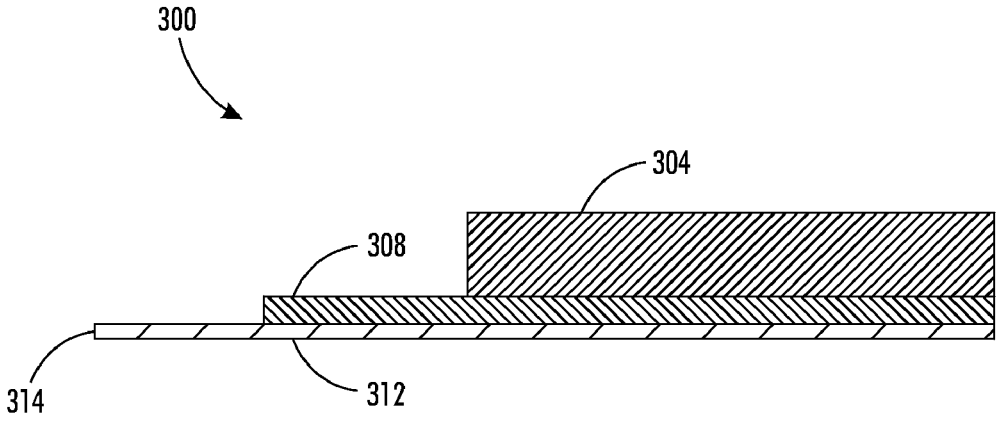
FIG. 3 is a cross-sectional view of an alternative stripper blade.

A cross sectional view of an alternative embodiment of a stripper blade suitable for use with the system of FIG. 1A and FIG. 1B is depicted in FIG. 3. The stripper blade 300 has a metal layer 312 laminated to a first polymer layer 308. In the example embodiment of FIG. 3, the metal layer 312 is typically formed from a sheet of metal such as stainless steel, and is 26 mm in length and is up to 0.051 mm thick. The first polymer layer 308 is typically formed of Mylar, and is recessed from the leading edge 314 such that metal layer 312 extends approximately 1 mm beyond the first polymer layer 308. The first polymer layer 308 is 0.076 mm thick and is 25 mm wide. The second polymer layer 304 is also formed from Mylar and is approximately 0.229 mm thick and 22 mm wide. The second polymer layer is further recessed from the leading edge of the first polymer layer 308 by 3 mm. The polymer layers 304 and 308 are constructed with sufficient deformation range to allow the attached metal layer 312 to engage the print drum with a desired contact load and angle of attack, while providing enough stiffness to overcome force applied by print media being stripped from the print drum. As with the stripper blade 200 depicted in FIG. 2, the stripper blade 300 may be biased against the print drum, and is configured to deform into a curved shape with an angle of attack between approximately 10 and 14 degrees when biased against the print drum. In the curved shape, the leading edge 314 of metal layer 312 contacts the print drum first, with polymer layer 308 and 304 contacting the print drum after the metal layer 312.

While the stripper blades of FIG. 2 and FIG. 3 are described in detail, these are only examples of stripper blade configurations that are adapted for use in printers, and various alternative embodiments are envisioned. For example, the thickness of a stripper blade may vary according to multiple factors including the desired degree of blade deformation and the thickness of media sheets that are expected to pass through the printer. For printers configured to print to thicker media, such as cardboard, the preferred thickness for a stripper blade may be thicker than the precise embodiment disclosed above. The angle of attack and biasing pressure may also be adjusted in printers having differing print drum diameters and rotational speeds. Various appropriate materials, such as aluminum or alternative polymers, may be substituted for use in the stripper blade in alternative printer designs as well.

Figure 4A:
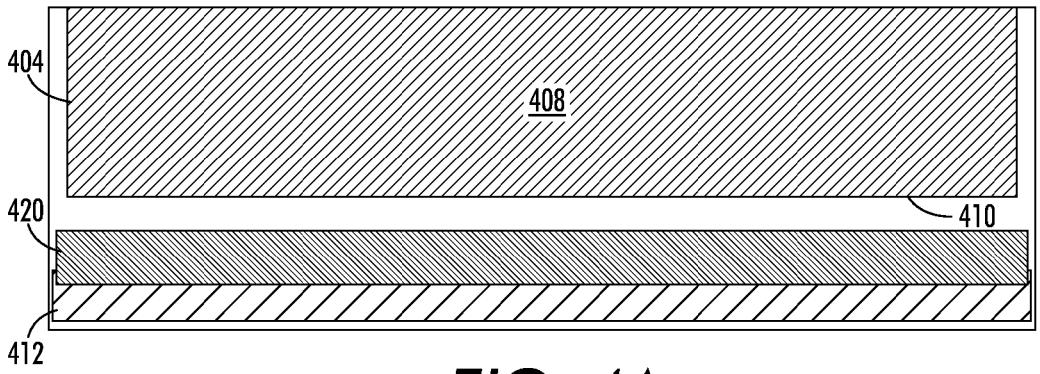
FIG. 4Ais a front side view of a print drum with a media sheet and a stripper blade with a uniform leading edge.
Figure 4B:
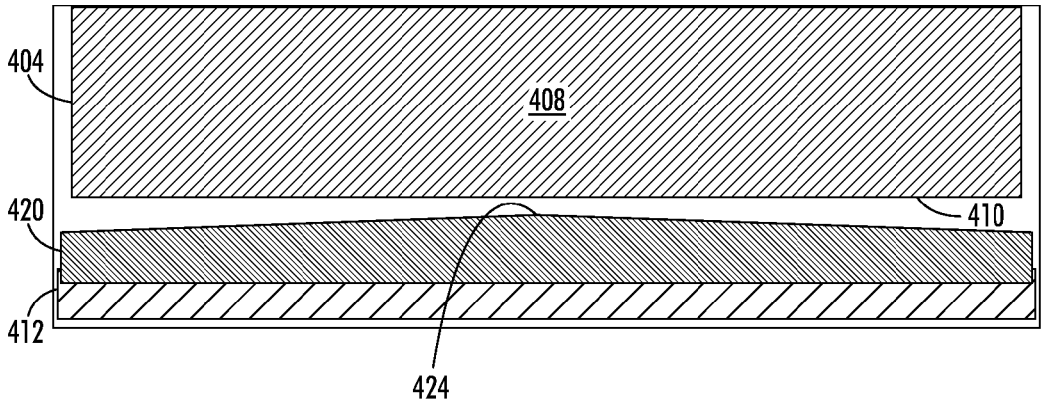
FIG. 4B is a front side view of a print drum with a media sheet and a stripper blade with a tapered leading edge.

FIG. 4A and FIG. 4B depict frontal views of two alternative stripper blade arrangements suitable for use with the stripper blade system depicted in FIG. 1A and FIG. 1B. In FIG. 4A, the stripper blade 416 has a horizontally uniform leading edge and is held by blade holder 412. The print drum 404 rotates, carrying a media sheet 408 towards the stripper blade 416. If the stripper blade 416 is biased against the print drum 404, the stripper blade 416 separates the media sheet 408 from the surface of print drum 404 when the leading edge of the media sheet 410 meets the edge of the stripper blade 416. In the alternative embodiment of FIG. 4B, the stripper blade 420 also engages the leading edge 410 of the media sheet 408. In FIG. 4B, the stripper blade 420 has a tapered leading edge with an apex point 424 that engages the media sheet 408 first. As the print drum 404 carries media sheet 408 towards the stripper blade 420, the tapered leading edge gradually engages the entire media sheet edge 410, separating the media sheet 408 from the print drum 404. In both FIG. 4A and FIG. 4B the stripper blade is approximately the same width as the print drum 404. Either of the stripper blades exemplified in FIG. 2 or FIG. 3 may be adapted for use in FIG. 4A or FIG. 4B. The blade holder 412 may engage with an electromechanical actuator in the manner depicted in FIG. 1A and FIG. 1B.

Figure 5:
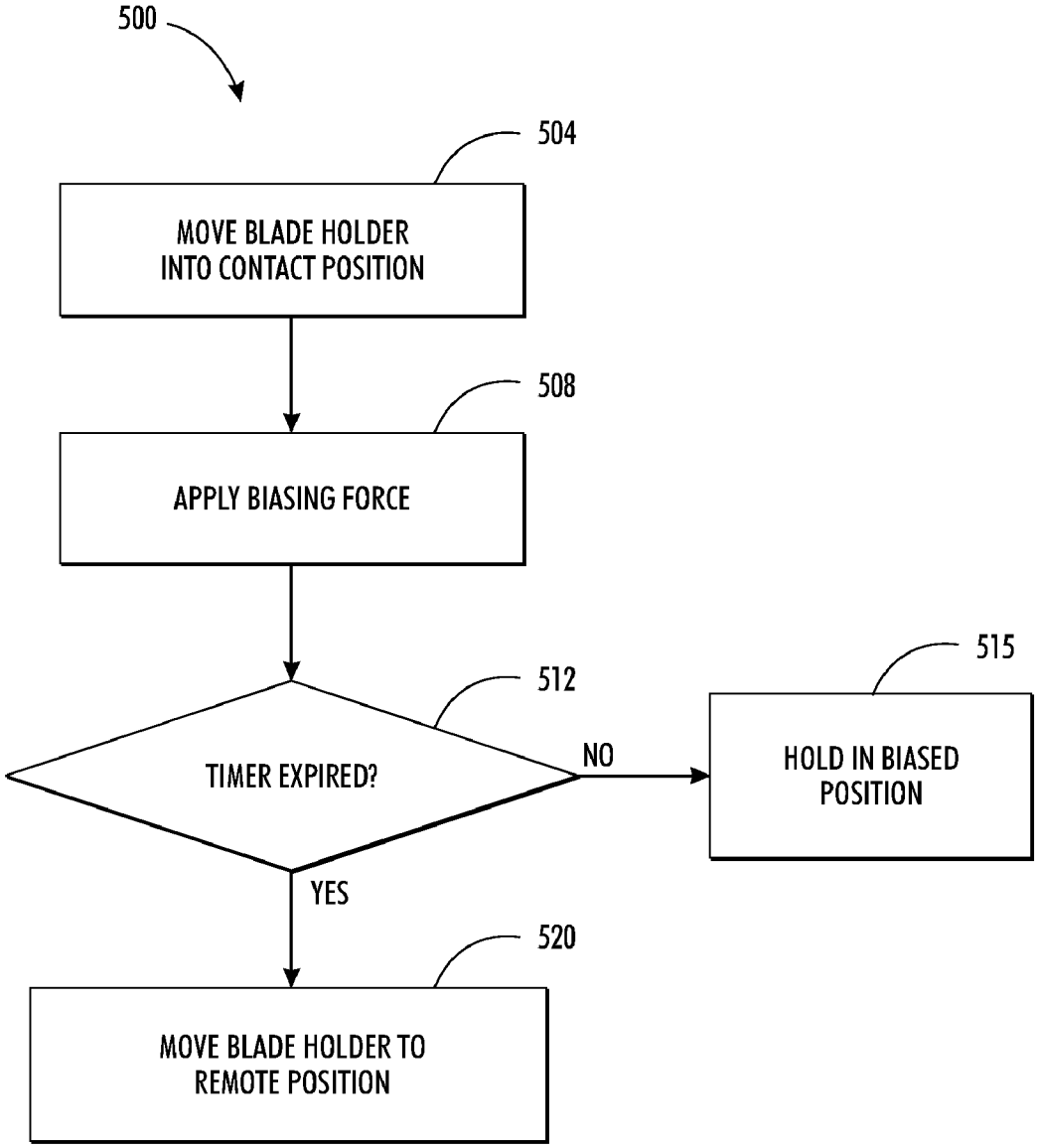
FIG. 5 is a flow diagram of a process for controlling a stripper blade system.

A method for controlling a stripper blade system such as the system depicted in FIG. 1A and FIG. 1B is shown in FIG. 5. The stripper blade control process 500 starts by moving the blade holder into the contact position (block 504). Moving the stripper blade holder causes the attached stripper blade to come in contact with an intermediate imaging member, such as a print drum. The stripper blade is biased against the intermediate imaging member prior to the arrival of the leading edge of a media sheet at the location where the stripper blade engages the intermediate imaging member (block 508). The biasing is accomplished by moving the stripper blade holder against a stop member, such as stop member 140 from FIG. 1A. The biasing force is applied for a predetermined period of time (block 512) where the stripper blade is held in the biased position (block 516). This predetermined period of time may vary depending upon factors such as the speed of the intermediate imaging member and the physical dimensions of the media sheet. The time should be sufficient to separate at least a leading portion of the media sheet from the intermediate imaging member such that the remaining portion of the media sheet will also separate from the intermediate imaging member. After the predetermined time period expires, the blade holder is moved to a remote position (block 520), removing the stripper blade from contact with the intermediate imaging member.

In operation, ink is ejected from at least one print head onto the surface of the print drum, forming a latent image. The transfix roller is moved into a transfix nip position with the print drum, and the print drum rotates, carrying a media sheet through the transfix nip to transfer the latent image from the print drum to the media sheet. The stripper blade is biased against the surface of the print drum at a position ahead of the leading edge of the media sheet after the leading edge of the media sheet emerges from the transfix nip. The stripper blade remains biased against the print drum for a predetermined amount of time allowing at least the leading portion of the media sheet to separate from the rotating print drum. At least a portion of the media sheet surface that was in contact with the print drum contacts the stripper blade as the media sheet separates from the print drum. The stripper blade is removed from contact with the print drum after sufficient time has passed to separate the media sheet from the print drum. The transfix roller is removed from the transfix nip after the media sheet has passed through the transfix nip. The process recited above may be repeated for multiple media sheets in a printer. Although the embodiments discussed above related to a stripper blade interacting with an intermediate imaging member, such as a print drum, the stripper blade may be used to facilitate the separation of printed media from other cylindrical rollers, such as heated rollers, i.e., fuser rollers, and unheated rollers in the media path.

Figure 6:
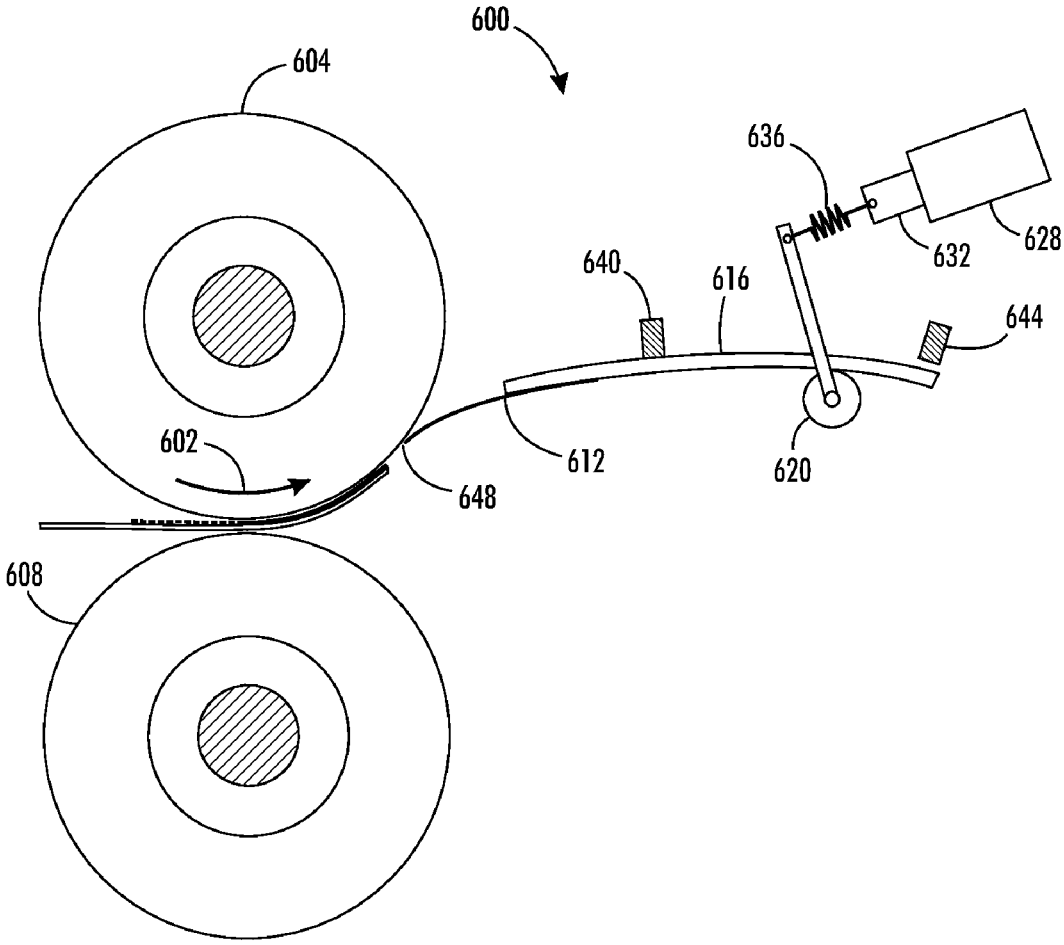
FIG. 6 is a side view of a stripper blade system that engages a fuser roller to enable separation of media from the fuser roller after the media exits a nip between the fuser roller and a pressure roller.

In known xerography imaging systems, toner is attracted to electrical charge forming a latent image on an intermediate imaging member. The image is transferred to media and then the toner image on the media is fused to the media by passing the media with the toner image through a fusing nip formed between a fuser roller and a pressure roller. A fuser roller 604 and a pressure roller 608 are shown in FIG. 6. In a typical xerography imaging system, the fuser roller is heated to a temperature in a range of about 80 degrees to about 120 degrees Celsius and the pressure generated in the nip is in a range of about 0.3 $N/mm^2$ to about 1 $N/mm^2$. In previously known xerography systems, plastic fingers were used to strip media from the fuser roller. Metal blades having a width as wide as the fuser roller were not used because the relatively high temperature differences to which the full width metal blades were exposed induced severe process direction buckling. This buckling affected consistent placement of the leading edge of the stripper blade at a position relative to the nip position that was effective for stripping the media from the fuser roller. To overcome that issue, relatively narrow plastic fingers were used to strip the media from the fuser roller.

The stripper blade system 600 shown in FIG. 6 enables metallic blades to be used for stripping media from a fuser roller and still maintain consistent placement of the leading edge of the blade against the fuser roller. In the system 600, the stripper blade 612 is biased against the surface of the fuser roller 604, which is rotating in a counterclockwise direction shown by arrow 602. As shown, the stripper blade 612 is biased against the surface of the fuser roller 604 at location 648 with a pressure of approximately 0.033 lb/in to about 0.083 lb/in. The stripper blade 612 is deformed by a biasing force supplied by the blade holder 616 being urged against stop member 640 by support arm 624 that is rotatably attached to a pivot 620 at one end and a spring 636 at the other end. An actuator 628, which is typically an electromechanical device, such as a servo or solenoid, moves an actuator arm 632 to extend a spring 636 to urge the support arm 624 and blade holder 616 against the stop member 640. The forces from actuator 628 and stop member 640 maintain a biasing pressure of approximately 0.033 lb/in to 0.083 lb/in as the fuser roller 604 rotates and the stripper blade 612 engages media sheets at an acute angle formed at location 648 between the fuser roller 604 and stripper blade 612. In one embodiment, this angle is between approximately 10 and 14 degrees. This angle is also known as the "angle of attack", and in the example embodiment, the angle of attack range facilitates separation of media bearing a toner image from the fuser roller 604. The biasing of the stripper blade 612 curves the blade 612 and enables the leading edge of the stripper blade 612 to engage the fuser roller 604 uniformly. The stop member 644 operates to limit the range of motion for the blade holder 616 when the actuator 628 releases the spring 636.

The stripper blade 612 has at least one metallic layer, which may be formed from stainless steel, although other materials may be used. The surface of the fuser roller 604 may also metallic, typically being anodized aluminum, although elastomer coated rollers may be used. Generally, the stripper blade has a thickness of about one-half the thickness of the media most commonly used in the xerography system. In one embodiment, the media has a thickness of about 0.1 mm so the stripper blade has a thickness of about 0.06 mm. The stripper blade 612 is attached to a blade holder 616, which may be formed from a polymer compound, such as a thermoplastic adapted to secure the stripper blade 612, although other suitable materials may be used.

In the embodiments described above, a single stripper blade has notable advantages over a plurality of discontinuous fingers for a number of reasons. For one, the discontinuous fingers may not successfully remove media if the media between the fingers remains adhered or substantially adhered to the roller. The single metallic blade is also better able to handle variable loading that varies with the degree to which the media is adhered to the roller from which the media is being removed. Additionally, the biasing and stop members enable the blade to engage the roller adequately for media removal without damaging the roller or the blade, particularly in metal-on-metal contact. The biasing force also enables a single metal blade to be used in a fuser environment without buckling occurring. Thus, the single metal blade and biasing mechanism provide reliable media stripping in a variety of imaging environments.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

We claim:

1. A printer comprising:

a print drum configured to receive ink ejected by a print head;

a transfix roller located proximate to the print drum;

a stripper blade system comprising:

a metallic blade having a leading edge that is configured to have a thickness that is at most equal to one-half a thickness of a media sheet passing through a nip formed by the print drum and the transfix roller;

a blade holder to which the metallic blade is mounted;

a support arm having one end rotatably attached to a pivot positioned on one side of the blade holder and a second end that is positioned on a second side of the blade holder that is opposite the first side of the blade holder;

an actuator having a moveable arm;

a stop member positioned on the second side of the blade holder;

a spring that is operatively connected at a first end to the moveable arm of the actuator and is operatively connected at a second end to the second end of the support arm; and a controller configured to operate the transfix roller to form a transfix nip with the print drum selectively and to operate the actuator to move the blade holder from a position in which the blade holder is out of engagement with the stop member to a position in which the blade holder contacts the stop member to bias the leading edge of the metallic blade against the print drum to facilitate removal of media from the print drum.

2. The printer of claim 1 wherein the metallic blade is substantially comprised of stainless steel.

3. The printer of claim 1 wherein the metallic blade has a width that is approximately equal to a width of the print drum.

4. The printer of claim 1 wherein the leading edge of the metallic blade is biased against the intermediate imaging member with a pressure in a range of about 0.033 lb/in to about 0.083 lb/in.

5. The printer of claim 1 wherein the leading edge biased against the surface of the print drum forms an angle between the leading edge and the surface of the print drum that is in a range of about 10 degrees to about 14 degrees.

6. The printer of claim 1 wherein the leading edge of the metallic blade is tapered to enable a point to be located at a center portion of the metallic blade across a width of the metallic blade.

7. The printer of claim 1 wherein the leading edge of the metallic blade has a thickness that is less than 0.06 millimeters.

* * * * *